US008919647B2

(12) United States Patent
Chen et al.

(10) Patent No.: US 8,919,647 B2
(45) Date of Patent: Dec. 30, 2014

(54) SIGHTS AND METHODS OF OPERATION THEREOF

(71) Applicants: Sintai Optical (Shenzhen) Co., Ltd., Shenzhen (CN); Asia Optical International Ltd., Tortola (GB)

(72) Inventors: Yen-Chao Chen, Taichung (TW); Chih-Hsien Lin, Taichung (TW); Tsung-Wei Lin, Taichung (TW); Szu-Han Wu, Taichung (TW); Jen-Chih Chung, Taichung (TW); Yung-Sheng Chiang, Taichung (TW)

(73) Assignees: Sintai Optical (Shenzhen) Co., Ltd., Shenzhen, Guandong Province (CN); Asia Optical International Ltd., Tortola (VG)

( * ) Notice: Subject to any disclaimer, the term of this patent is extended or adjusted under 35 U.S.C. 154(b) by 0 days.

(21) Appl. No.: 13/769,881

(22) Filed: Feb. 19, 2013

(65) Prior Publication Data

US 2014/0166750 A1 Jun. 19, 2014

(30) Foreign Application Priority Data

Dec. 14, 2012 (TW) ..... 101147358 A

(51) Int. Cl.

| | |
|---|---|
| ***G06F 19/00*** | (2011.01) |
| ***G06G 7/80*** | (2006.01) |
| ***F41G 1/00*** | (2006.01) |
| ***F41G 1/40*** | (2006.01) |
| ***F41G 1/473*** | (2006.01) |

(52) U.S. Cl.

CPC .. *F41G 1/00* (2013.01); *F41G 1/40* (2013.01); *F41G 1/473* (2013.01)

USPC ..... 235/408; 235/404; 235/411; 235/417

(58) Field of Classification Search

CPC ..... F41G 1/38; F41G 1/473; F41G 3/04; F41G 3/26; F41G 3/2655; F41G 3/2661; F41G 7/36; F41J 5/02; F41J 5/12; G06G 7/48; G06G 7/80

USPC ..... 235/400–408, 412–414, 417

See application file for complete search history.

(56) References Cited

U.S. PATENT DOCUMENTS

| | | | | |
|---|---|---|---|---|
| 4,965,439 | A * | 10/1990 | Moore | 235/404 |
| 5,026,158 | A * | 6/1991 | Golubic | 356/252 |
| 5,926,259 | A * | 7/1999 | Bamberger et al. | 356/5.01 |
| 7,404,268 | B1 * | 7/2008 | Page | 42/137 |
| 2009/0218400 | A1 * | 9/2009 | Boss et al. | 235/404 |
| 2009/0320348 | A1 * | 12/2009 | Kelly | 42/119 |

(Continued)

*Primary Examiner* — Tuyen K Vo

(74) *Attorney, Agent, or Firm* — McClure, Qualey & Rodack, LLP

(57) ABSTRACT

A sight and methods of operation thereof are provided. In some embodiments, an image is captured via an image capture unit, and a center position is calculated according to the positions of at least three impact points in the image, and a predefined view center of a display unit is set to the center position. In some embodiments, an angle of dip of the sight to a plane is detected via a dip angle detector. A predictive impact point is calculated according to the angle of dip and at least one calculation parameter, and an impact point indication is accordingly displayed in the display unit. When the angle of dip is changed, the predictive impact point is recalculated according to the new angle of dip, and the corresponding impact point indication is displayed.

20 Claims, 10 Drawing Sheets

(56) References Cited

U.S. PATENT DOCUMENTS

2010/0034426 A1* 2/2010 Takiguchi et al. ..... 382/106
2010/0145669 A1* 6/2010 Norden et al. ..... 703/7
2011/0030264 A1* 2/2011 Davidson et al. ..... 42/122
2011/0114725 A1* 5/2011 Young ..... 235/407
2012/0126002 A1* 5/2012 Rudich ..... 235/404

* cited by examiner

SIGHTS AND METHODS OF OPERATION THEREOF

BACKGROUND OF THE INVENTION

1. Field of the Invention

The disclosure relates generally to sights and methods of operation thereof, and more particularly, to sights and methods of operation thereof that can automatically perform a zeroing calibration and provide shooting prompts.

2. Description of the Related Art

Currently, several aiming mechanisms have been developed to assist users to launch devices, such as firearms comprising rifles or targeting guns. A common aiming mechanism is to set a sight on the firearm. The sight can enlarge a target object with a specific scale factor, and provide a reticule to assist users to aim the target.

Although the sight can assist users to aim, however, the operations of the sight always become persecutions for users, and the achievable effects are always limited. For example, before the use of a sight, users need to perform a "zeroing calibration" or called "zero shooting". By performance of the zeroing calibration, the error of the user or the firearms itself can be corrected. Conventionally, the above zeroing calibration is performed by shooting a target located at a specific distance to the firearms by the user, and adjusting the firearms and the sight according to the deviation situation between the positions of the projectile, such as a bullet and the target. The above procedure must be performed repeatedly until the projectile hits the target. The conventional performance of the zeroing calibration is inconvenient for users.

Additionally, during an actual shooting procedure, several factors, such as the temperature, the pressure, the humidity, the wind speed, the wind direction, the wind resistance, the pose of user, and the dip of firearms can affect the marching distance and trajectory of the projectile. Therefore, even if the user's firearms is equipped with a sight, and a zeroing calibration is performed to correct the sight, the subsequent actual shooting still need adjustments based on user's experiences. For example, when the distance from the target is greater than the distance used in the zeroing calibration for the sight, the user must aim the reticule of the sight to an upper point of the target. Additionally, when the wind comes from left or right, the user must aim the reticule of the sight to a point with a left deviation or a right deviation to the target, thus to compensate the influence of the wind to the projectile trajectory. Conventionally, the reticules of some sights may have marks of angle increment, thus to assist users to perform appropriate deviation adjustment. However, it still needs greatly experiences and conjectures from users.

BRIEF SUMMARY OF THE INVENTION

Sights and methods of operation thereof are provided. The sight can automatically perform a zeroing calibration and/or provide shooting prompts, thus to provide more convenient and efficient shooting aiming assists.

An embodiment of a sight comprises a display unit, an image capture unit, and a processing unit. The image capture unit obtains an image, wherein the image has at least three impact points on a target. The processing unit calculates a center position according to the positions of the at least three impact points in the image, and sets a predefined view center of the display unit to the center position.

In an embodiment of a method of operation for a sight, an image is captured via an image capture unit, wherein the image has at least three impact points on a target. Then, a center position is calculated according to the positions of the at least three impact points in the image, and a predefined view center of a display unit is set to the center position.

In some embodiments, an image range obtained by the image capture unit can be larger than a view range of the display unit. After the predefined view center is set to the center position of the at least three impact points, the display unit obtains an image portion corresponding to the view range from the image range according to the center position, thus to display the image portion in the display unit.

In some embodiments, the at least three impact points are generated by shooting projectiles on the target by a firearms equipped with the sight according to the predefined view center, and the at least three impact points are within a predefined range.

An embodiment of a sight comprises a display unit, a dip angle detector, and a processing unit. The dip angle detector detects an angle of dip of the sight to a plane. The processing unit calculates a predictive impact point according to the angle of dip and at least one calculation parameter, and displays an impact point indication in the display unit accordingly to the predictive impact point. When the angle of dip is changed, the processing unit recalculates the predictive impact point according to the new angle of dip, and displays the corresponding impact point indication in the display unit.

In an embodiment of a method of operation for a sight, an angle of dip of the sight to a plane is detected via a dip angle detector. A predictive impact point is calculated according to the angle of dip and at least one calculation parameter, and an impact point indication is accordingly displayed in the display unit. When the angle of dip is changed, the predictive impact point is recalculated according to the new angle of dip, and the corresponding impact point indication is displayed in the display unit.

In some embodiments, a distance between the sight and a target can be obtained by using a distance measurement method, and a specific prompt is displayed in the display unit according to the predictive distance. In some embodiments, the specific prompt can comprise a text display, a numeral display, and/or a symbol display corresponding to the predictive distance, and/or a specific indication displayed at a specific position corresponding to the predictive distance in the display unit.

In some embodiments, it is determined whether the impact point indication overlaps with the specific indication. If the impact point indication overlaps with the specific indication, a registration prompt is generated. In some embodiments, the registration prompt can comprise a voice, a text, and/or a change of color of the impact point indication or the specific indication.

An embodiment of a sight comprises a display unit, a dip angle detector, an image capture unit, and a processing unit. The dip angle detector detects an angle of dip of the sight to a plane. The image capture unit obtains an image, wherein the image has an impact point indication and an actual impact point on a target, and a predictive impact point is calculated according to the angle of dip and at least one calculation parameter, wherein the impact point indication is displayed in the display unit according to the predictive impact point. The processing unit calculates a compensation angle according to a pixel interval between the impact point indication and the actual impact point in the image, a resolution of the image, and a vertical view angle of the sight, and calculates a compensated angle of dip according to the angle of dip and the compensation angle. The processing unit calculates an error factor of the at least one calculation parameter according to the compensated angle of dip, the predictive impact point, and the at least one calculation parameter, and updates the at least one calculation parameter using the error factor.

In an embodiment of a method of operation for a sight, an image is obtained by an image capture unit, wherein the image has an impact point indication and an actual impact point on a target. An angle of dip is detected by a dip angle detector, a predictive impact point is calculated according to the angle of dip and at least one calculation parameter, and the impact point indication is displayed in the display unit according to the predictive impact point. Then, a compensation angle is calculated according to a pixel interval between the impact point indication and the actual impact point in the image, a resolution of the image, and a vertical view angle of the sight, and a compensated angle of dip is calculated according to the angle of dip and the compensation angle. Then, an error factor of the at least one calculation parameter is calculated according to the compensated angle of dip, the predictive impact point, and the at least one calculation parameter, and the at least one calculation parameter is updated using the error factor.

In some embodiments, the error factor may be an initial velocity of a projectile.

Methods of operation for sights may take the form of a program code embodied in a tangible media. When the program code is loaded into and executed by a machine, the machine becomes an apparatus for practicing the disclosed method.

BRIEF DESCRIPTION OF THE DRAWINGS

The invention will become more fully understood by referring to the following detailed description with reference to the accompanying drawings, wherein.

DETAILED DESCRIPTION OF THE INVENTION

Sights and methods of operation thereof are provided.

Figure 1:
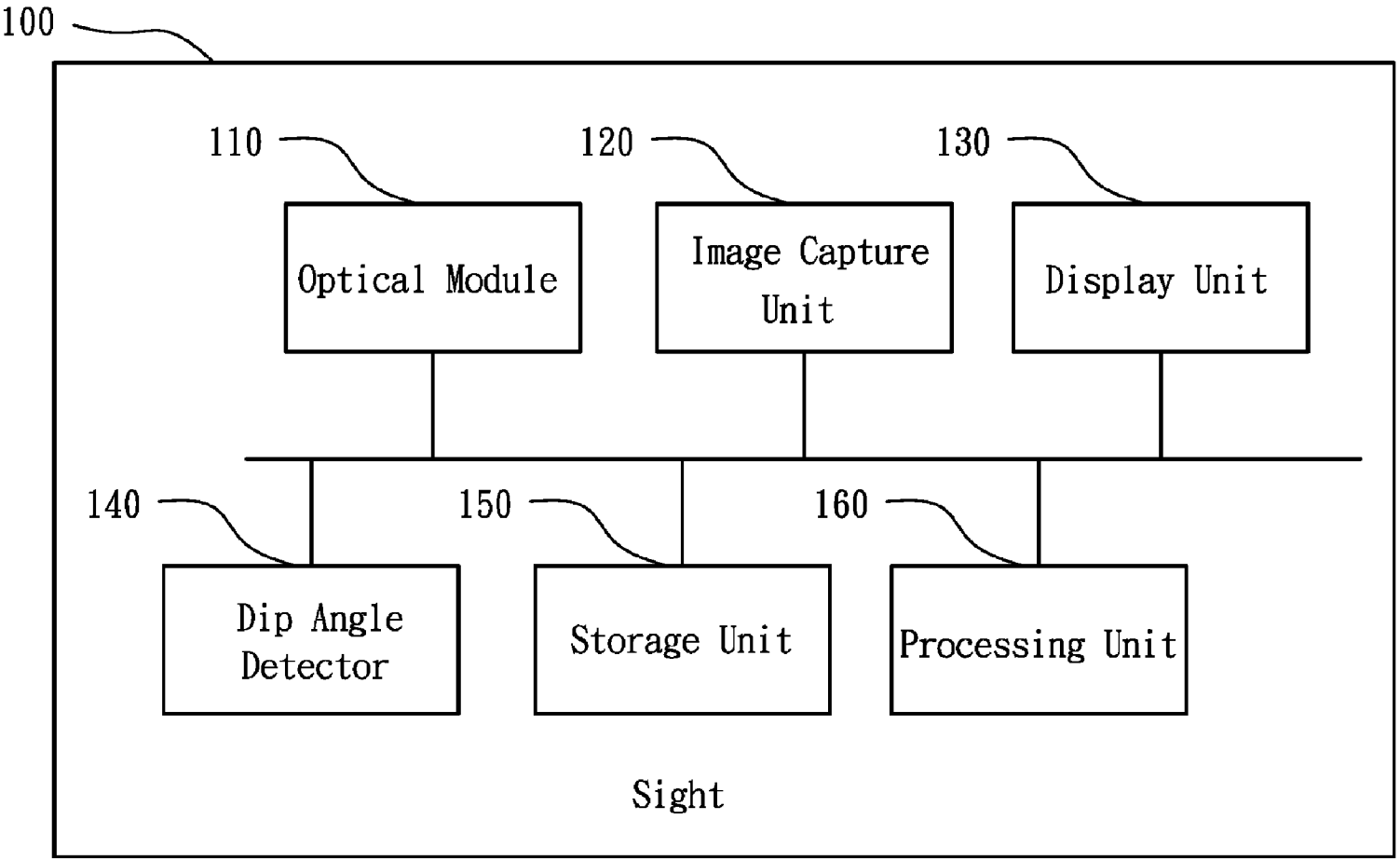
FIG. 1 is a schematic diagram of an embodiment of the structure of a sight of the invention.

FIG. 1 is a schematic diagram of an embodiment of the structure of a sight of the invention. It is noted that, the sight of the present invention can be set on a shooting device, such as a firearms comprising a rifle or a targeting gun, a bow, or a crossbow. The sight 100 can comprise an optical module 110, an image capture unit 120, a display unit 130, a dip angle detector 140, a storage unit 150, and a processing unit 160.

The optical module 110 can comprise at least an object lens used to perform optical mirroring for a subject located at a distant location. The image capture unit 120 may be a CCD (Charge Coupled Device) component or a CMOS (Complementary Metal-Oxide Semiconductor) component, placed at the imaging position for objects inside the electronic device. It is understood that, in some embodiments, the image capture unit 120 may be independent of the sight 100, and located outside of the sight 100. The image capture unit 120 can provide the captured image to the sight 100 for subsequent process. The display unit 130 can display related images, data, and/or related figures and interfaces. It is understood that, in some embodiments, the display unit 130 may be a head mounted display, a display panel, and/or a view finder. Noted that, in some embodiments, the view finder can be implemented by adding a magnification eyepiece on a micro-display. It is noted that, in some embodiments, the display unit 130 has a view range, and has a predefined view center, and a mark corresponding to the predefined view center, used to assist users for aiming. It is understood that, in some embodiments, the optical module 110 may have no back-end upright optics group and/or eyepiece. The back-end upright optics group and the eyepiece can be replaced by the image capture unit 120 and the display unit 130. The dip angle detector 140 can detect an angle of dip of the sight 100 to a plane. In some embodiments, the dip angle detector 140 may be a G sensor, a gyroscope, a multi-step mercury switch, and so on. It is understood that, the above dip angle detectors 140 are only examples of the present application, and the present invention is not limited thereto. Any detector which can detect an angle of dip of the sight 100 to a plane can be used in the present invention. It is noted that, in some embodiments, the sight 100 can perform a zeroing calibration (zero shooting). The dip angle detector 140 can detect the angle of dip at this time, and record the angle of dip after the zeroing calibration. Thereafter, the dip angle detector 140 detects the angle of dip of the sight 100 to the plane based on the angle of dip after the zeroing calibration. The storage unit 150 can permanently or temporarily store the images captured by the image capture unit 120, and/or the corresponding image files. The processing unit 160 can perform the methods of operation for sights of the present invention, which will be discussed as follows.

Figure 9:
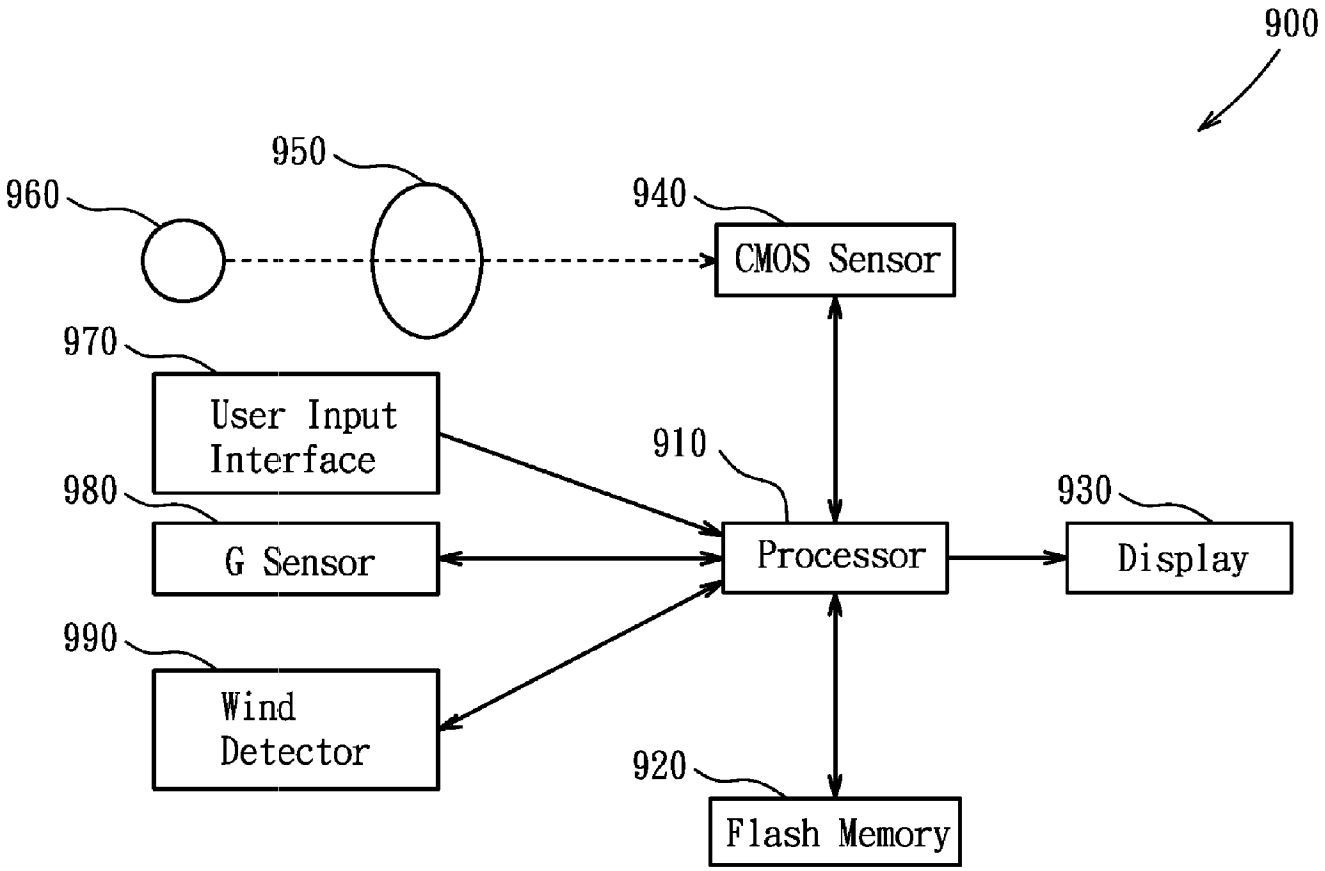
FIG. 9 is a schematic diagram of an embodiment of an example of a sight of the invention.

For example, FIG. 9 is a schematic diagram of an embodiment of an example of a sight of the invention. As shown in FIG. 9, the sight 900 comprises a processor 910, a flash memory 920, a display 930, a CMOS sensor 940, an optical module 950, a user input interface 970, a G sensor 980, and a wind sensor 990. The optical module 950 may have no back-end upright optics group and eyepiece. The optical module 950 can use an objective lens to directly project an object 960 to the CMOS sensor 940, and the processor 910 triggers the display 930 to display the image corresponding to the object 960. Users can input related data via the user input interface 970. In some embodiments, the distance between the sight 900 and the object 960 can be input via the user input interface 970. The G sensor 980 can detect an angle of dip of the sight 900 to a plane, and transmit the detected data to the processor 910. Similarly, the wind sensor 990 can detect the wind direction and velocity applied on the sight 900, and transmit the detected data to the processor 910. The flash memory 920 can store related data received by the sight 900 from related components or generated by the processor 910. The processor 910 can perform the methods of operation for sights of the present invention according to the received data, for example, the operations for aiming, distance measurement, or shooting adjustment, and related details are discussed later.

Figure 2:
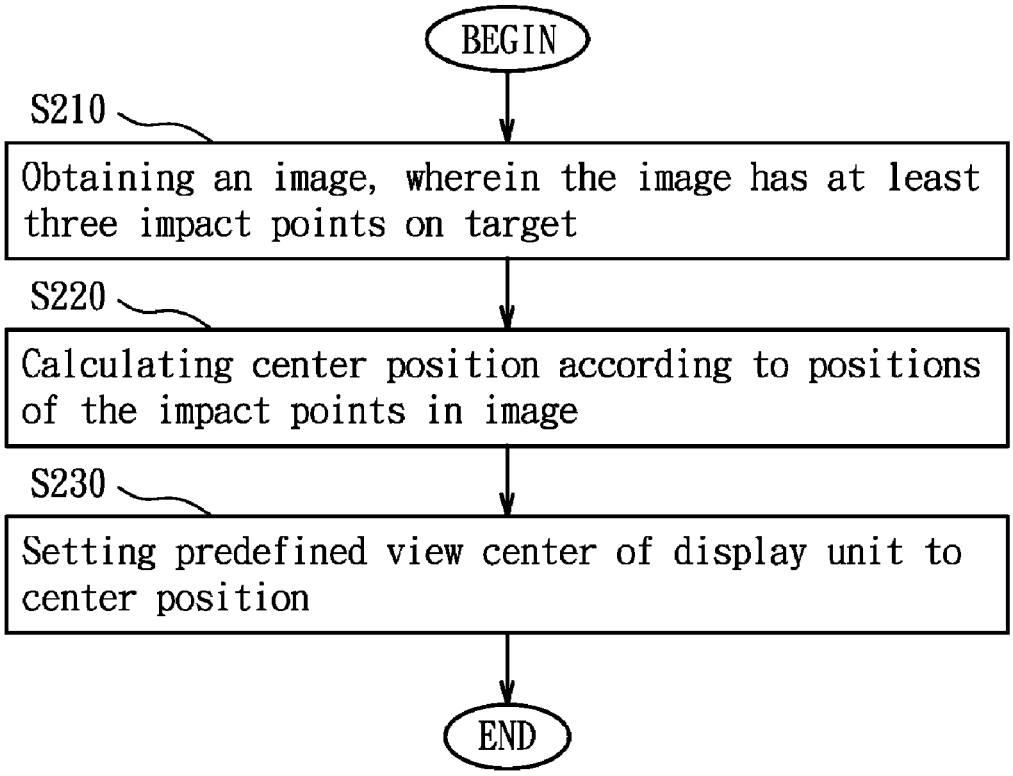
FIG. 2 is a flowchart of an embodiment of a method of operation for a sight of the invention.

FIG. 2 is a flowchart of an embodiment of a method of operation for a sight of the invention. It is noted that, the sight of the present invention can be set on a shooting device, such as a firearms comprising a rifle or a targeting gun, a bow, or a crossbow. In the embodiment, the zeroing calibration (zero shooting) of a sight can be automatically completed.

In step S210, an image is captured via an image capture unit, wherein the image has at least three impact points on a target. It is noted that, a user can aim the target according to a mark of a predefined view center of a display of the sight, and use the shooting device to shoot projectiles on the target at least three times, thus to generate the at least three impact points. Then, in step S220, a center position is calculated according to the positions of the at least three impact points in the image, and in step S230, the predefined view center of the display unit is set to the center position.

Figure 3A:
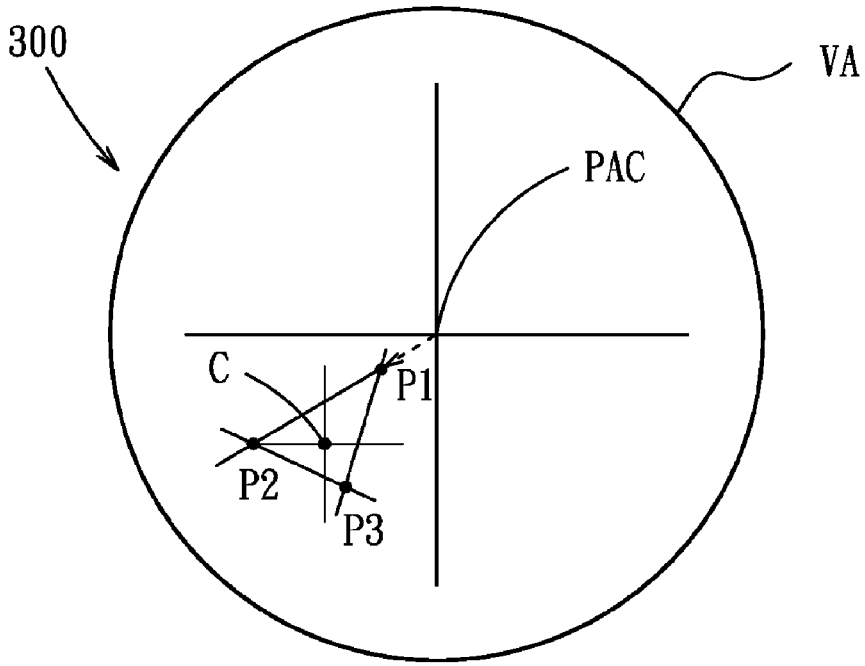
FIGS. 3A and 3B are schematic diagrams of an embodiment of an adjustment of a view center of the invention.
Figure 3B:
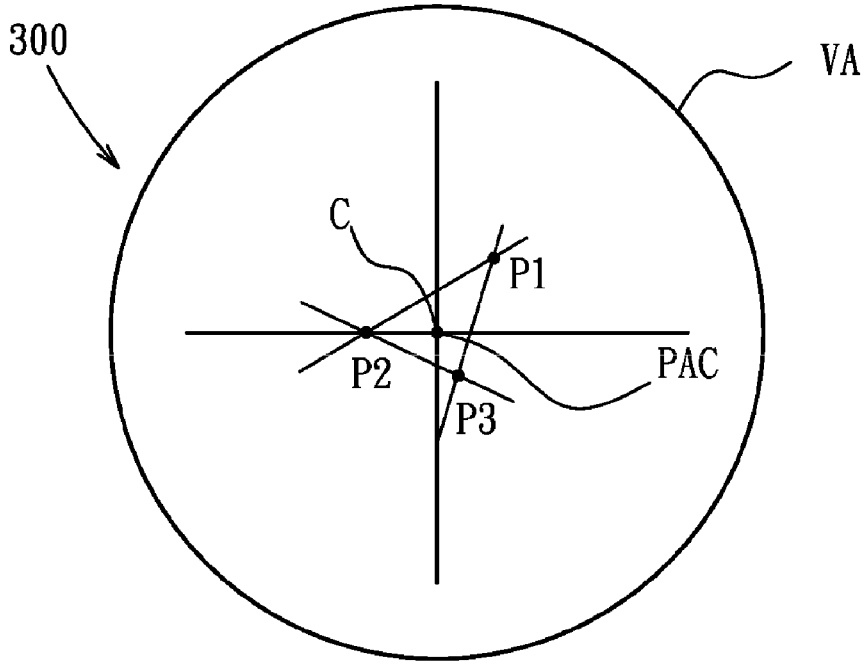

For example, the image 300 obtained by the image capture unit can comprise three impact points (P1, P2, P3), as shown FIG. 3A, wherein the view range VA of the display unit may has a predefined view center PAC. The center position C can be calculated according to the three impact points (P1, P2, P3) in the image 300. The predefined view center PAC of the display unit can be set to the center position C corresponding to the three impact points (P1, P2, P3), as shown in FIG. 3B. It is understood that, in some embodiments, an image range obtained by the image capture unit can be larger than a view range of the display unit. After the predefined view center is set to the center position C of the three impact points (P1, P2, P3), the display unit obtains an image portion corresponding to the view range from the image range according to the center position C, thus to display the image portion in the display unit.

Figure 4:
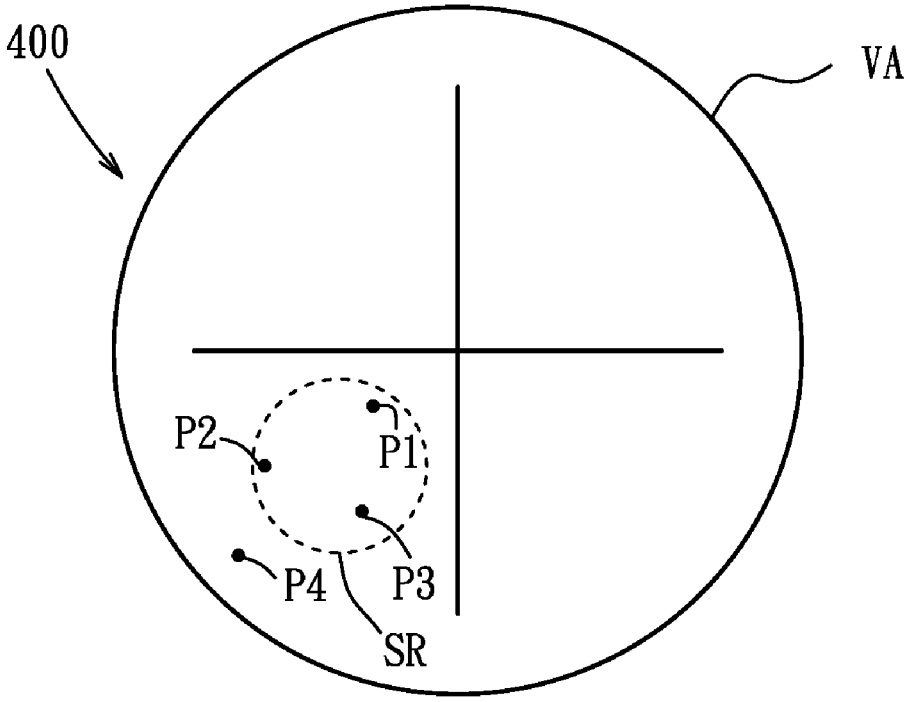
FIG. 4 is a schematic diagram of an embodiment of a filtering of impact points of the invention.

Additionally, the image obtained by the image capture unit can be applied with a filtering process. In some embodiments, the impact points that located outside of a predefined range of main impact points are excluded from calculation. For example, when four impact points (P1, P2, P3, P4) are in the image 400, as shown in FIG. 4, the impact point P4 located outside of the predefined range SR of main impact points are excluded from calculation. In other words, the three impact points (P1, P2, P3) within the predefined range SR will be used to calculate the corresponding center position.

Figure 5:
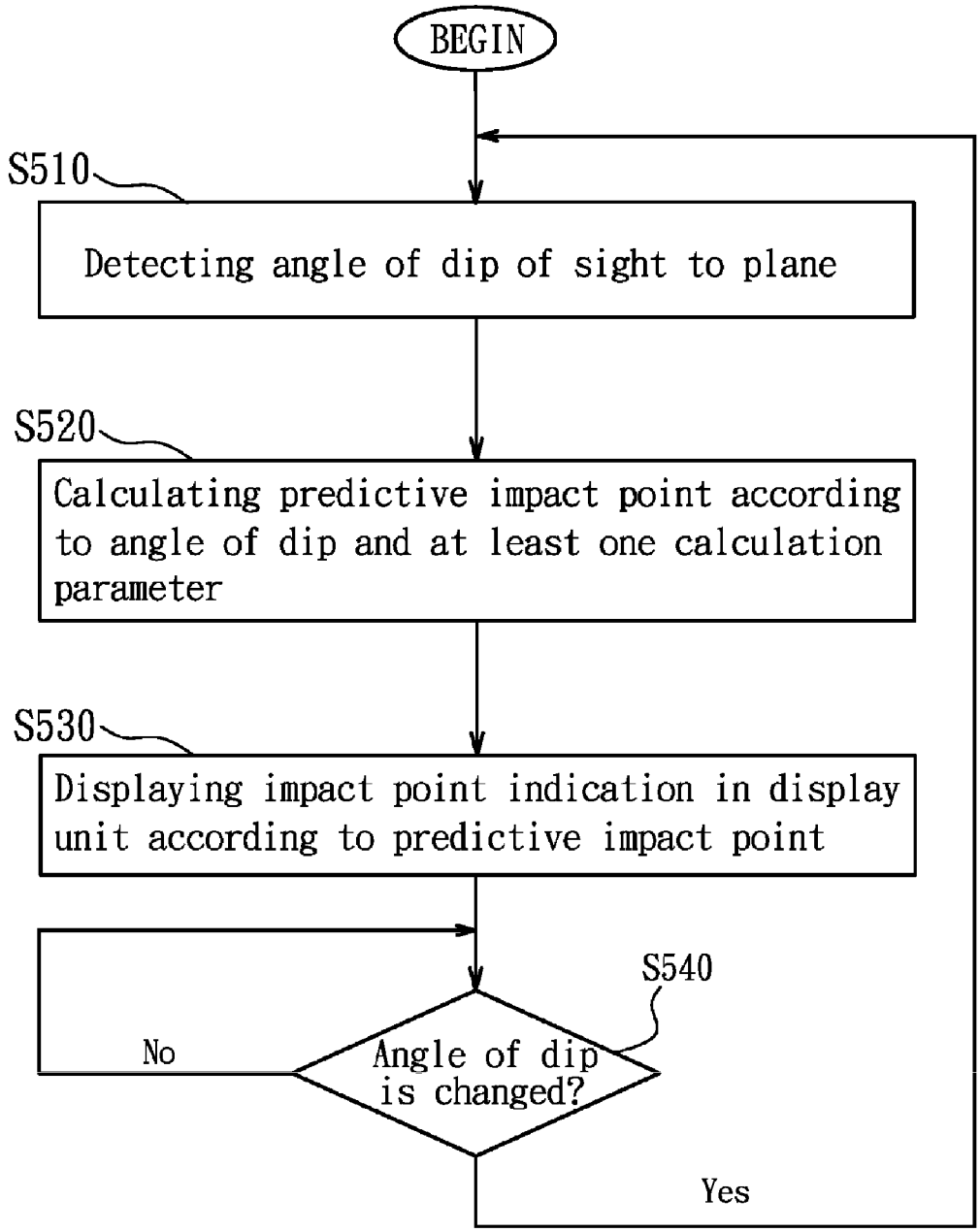
FIG. 5 is a flowchart of another embodiment of a method of operation for a sight of the invention.

FIG. 5 is a flowchart of another embodiment of a method of operation for a sight of the invention. It is noted that, the sight of the present invention can be set on a shooting device, such as a firearms comprising a rifle or a targeting gun, a bow, or a crossbow. In the embodiment, an aiming prompt can be dynamically displayed and adjusted according to the attitude of the sight.

In step S510, an angle of dip of the sight to a plane is detected via a dip angle detector. It is understood that, in some embodiments, the sight can perform a zeroing calibration, and the dip angle detector can detect the angle of dip at this time, and record the angle of dip after the zeroing calibration. Thereafter, the dip angle detector detects the angle of dip of the sight to the plane based on the angle of dip after the zeroing calibration. In step S520, a predictive impact point is calculated according to the angle of dip and at least one calculation parameter, and in step S530, an impact point indication is accordingly displayed in the display unit. It is understood that, in some embodiments, the at least one calculation factor can comprise the air resistance, the weight of the projectile, the velocity of the projectile, the wind velocity, and/or the wind direction. In some embodiments, the predictive impact point can be a distance between the target and the sight. The calculation corresponding to the predictive impact point can be performed according to the trajectory of the firearms equipped with the sight and the physics mechanics. It is noted that, the calculations for the trajectory and the predictive impact point are well-known, and omitted here. Additionally, the impact point indication can be displayed in the display unit according to the distance of the predictive impact point and the target distance used in the zeroing calibration. For example, when the distance of the predictive impact point is greater than the target distance used in the zeroing calibration, the impact point indication can be displayed below the predefined view center of the display unit. When the distance of the predictive impact point is less than the target distance used in the zeroing calibration, the impact point indication can be displayed above the predefined view center of the display unit. Then, in step S540, it is determined whether the angle of dip detected by the dip angle detector is changed. When the angle of dip is not changed (No in step S540), the determination of step S540 continues. When the angle of dip is changed (Yes in step S540), steps S510 to S530 are repeated, wherein the new angle of dip is obtained, and the predictive impact point is recalculated according to the new angle of dip and the at least one calculation factor, and the corresponding impact point indication is re-displayed in the display unit.

Figure 6A:
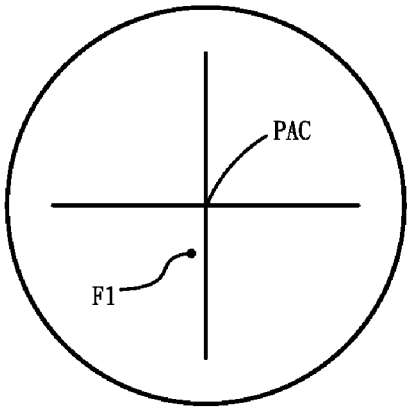
FIGS. 6A, 6B and 6C are schematic diagrams of an embodiment of indications corresponding to predictive impact points of the invention.
Figure 6B:
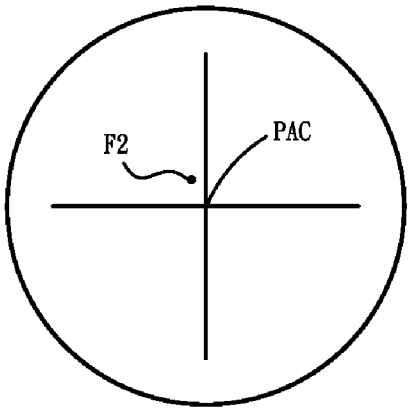
Figure 6C:
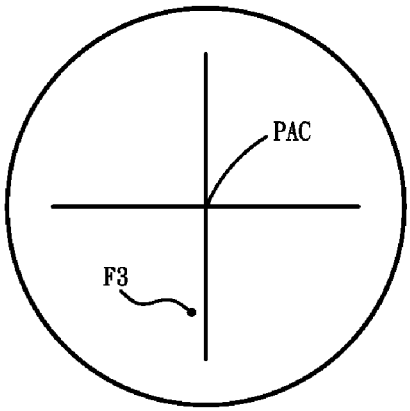

For example, when a user holds a firearms and turns it upward, and the dip angle detector detects the angle of dip A1 of the sight at this time, the sight can calculate the distance corresponding to the predictive impact point according to the angle of dip A1 and the related calculation factors, and display the corresponding impact point indication F1 in the display unit, as shown in FIG. 6A. Then, when the user turns the firearms downward, and the dip angle detector detects the angle of dip A2 of the sight at this time, the sight can calculate the distance corresponding to the predictive impact point according to the angle of dip A2 and the related calculation factors, and display the corresponding impact point indication F2 in the display unit, as shown in FIG. 6B. Similarly, when the user turns the firearms upward again, and the dip angle detector detects the angle of dip A3 of the sight at this time, the sight can calculate the distance corresponding to the predictive impact point according to the angle of dip A3 and the related calculation factors, and display the corresponding impact point indication F3 in the display unit, as shown in FIG. 6C.

Figure 7:
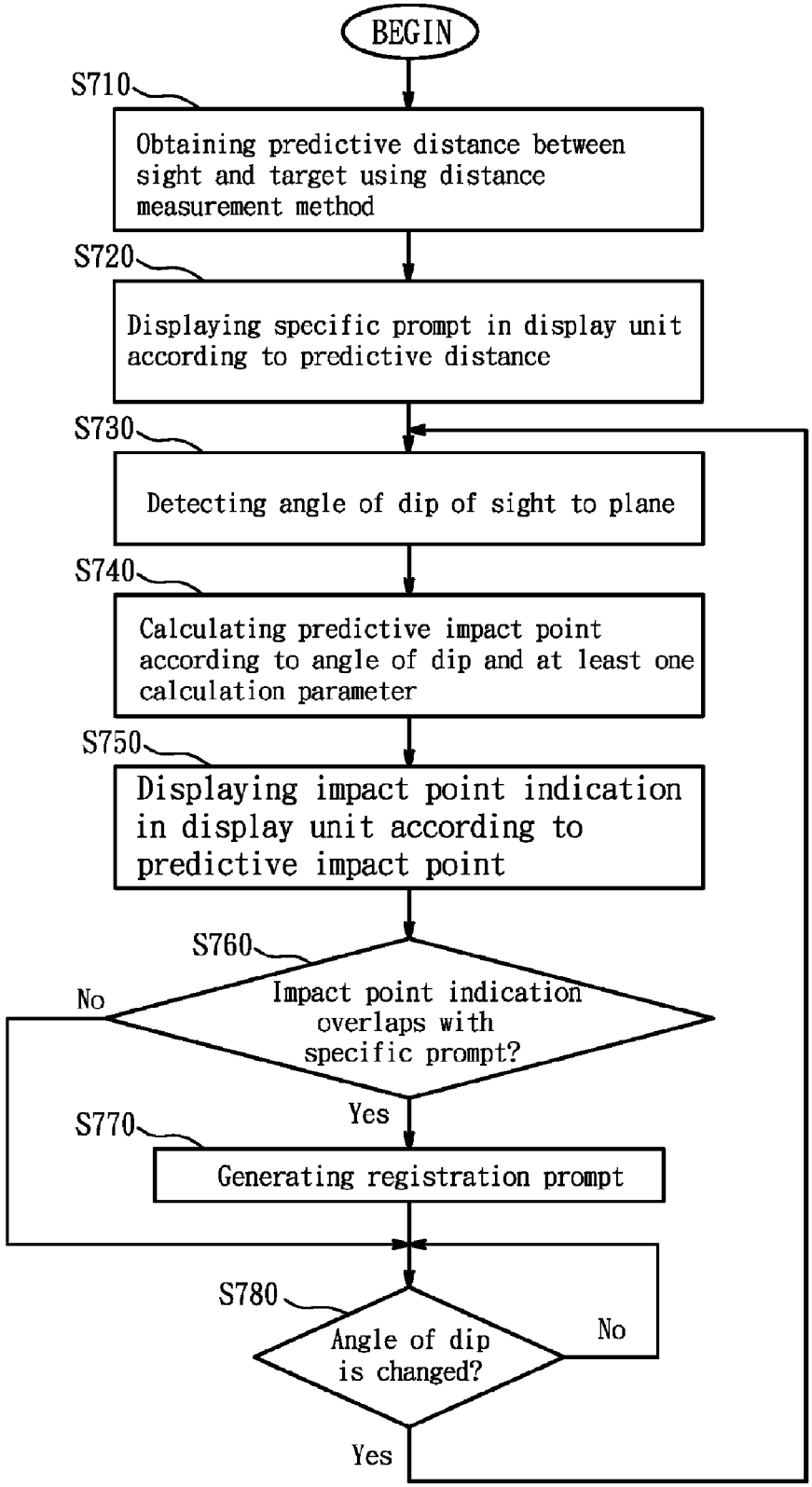
FIG. 7 is a flowchart of another embodiment of a method of operation for a sight of the invention.

FIG. 7 is a flowchart of another embodiment of a method of operation for a sight of the invention. It is noted that, the sight of the present invention can be set on a shooting device, such as a firearms comprising a rifle or a targeting gun, a bow, or a crossbow. In the embodiment, a specific indication corresponding to a predictive distance can be displayed in a display unit, and an aiming prompt can be dynamically displayed and adjusted according to the attitude of the sight.

In step S710, a predictive distance between the sight and a target is obtained by using a distance measurement method, and in step S720, a specific prompt is displayed in the display unit according to the predictive distance. It is understood that, in some embodiments, the distance measurement method can comprise a triangle distance measurement method, a laser distance measurement method, an IR distance measurement method, and/or an ultrasonic distance measurement method. It is noted that, the above distance measurement methods are only examples of the application, and the present invention is not limited thereto. Any tool or method that can measure the distance between the sight and the target can be applied in the present invention. Additionally, in some embodiments, the specific prompt can comprise a text display, a numeral display, and/or a symbol display corresponding to the predictive distance, and/or a specific indication displayed at a specific position corresponding to the predictive distance in the display unit. Then, in step S730, an angle of dip of the sight to a plane is detected via a dip angle detector. Similarly, in some embodiments, the sight can perform a zeroing calibration, and the dip angle detector can detect the angle of dip at this time, and record the angle of dip after the zeroing calibration. Thereafter, the dip angle detector detects the angle of dip of the sight to the plane based on the angle of dip after the zeroing calibration. In step S740, a predictive impact point is calculated according to the angle of dip and at least one calculation parameter, and in step S750, an impact point indication is accordingly displayed in the display unit. Similarly, in some embodiments, the at least one calculation factor can comprise the air resistance, the weight of the projectile, the velocity of the projectile, the wind velocity, and/or the wind direction. In some embodiments, the predictive impact point can be a distance between the target and the sight. The calculation corresponding to the predictive impact point can be performed according to the trajectory of the firearms equipped with the sight and the physics mechanics. Additionally, the impact point indication can be displayed in the display unit according to the distance of the predictive impact point and the target distance used in the zeroing calibration. Then, in step S760, it is determined whether the impact point indication overlaps with the specific indication. When the impact point indication does not overlap with the specific indication (No in step S760), the procedure goes to step S780. When the impact point indication overlaps with the specific indication (No in step S760), in step S770, a registration prompt is generated. It is understood that, in some embodiments, the registration prompt can comprise a voice, a text, and/or a change of color of the impact point indication and/or the specific indication. It is noted that, the registration prompt is used to notify the user for shooting. Then, in step S780, it is determined whether the angle of dip detected by the dip angle detector is changed. When the angle of dip is not changed (No in step S780), the determination of step S780 continues. When the angle of dip is changed (Yes in step S780), steps S730 to S770 are repeated.

Figure 8A:
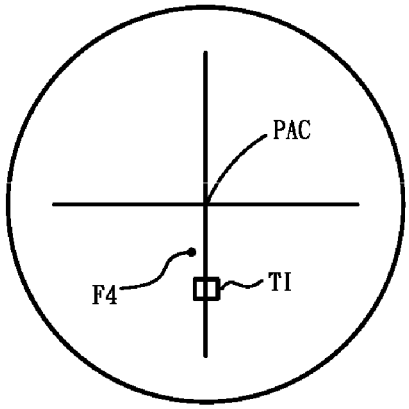
FIGS. 8A and 8B are schematic diagrams of an embodiment of indications corresponding to a predictive impact point and a predictive distance of the invention.
Figure 8B:
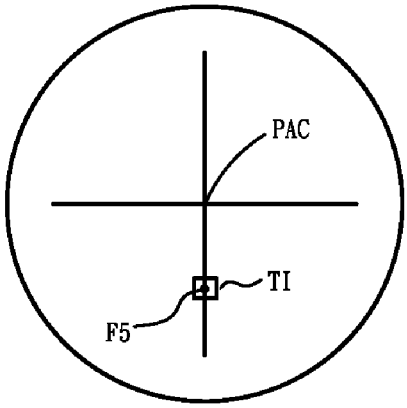

For example, the display unit can display a specific indication TI corresponding to the predictive distance and an impact point indication F4 obtained according to the angle of dip of the sight at this time, as shown FIG. 8A. When the user moves the firearms, such that the impact point indication F5 obtained according to the new angle of dip of the sight overlaps with specific indication TI, as shown FIG. 8B, the display unit displays a registration prompt. As described, in some embodiments, the registration prompt can comprise a voice, a text, and/or a change of color of the impact point indication and/or the specific indication, which is used to notify the user for shooting.

It is understood that, since various factors may be faced during the actual shooting, in order to solve the error problem corresponding to the trajectory compensation theory calculation, an error value during the actual shooting can be additionally considered, so as to compensate the trajectory to raise the accuracy, thereby increasing the precision of the sight and the shooting.

Figure 10:
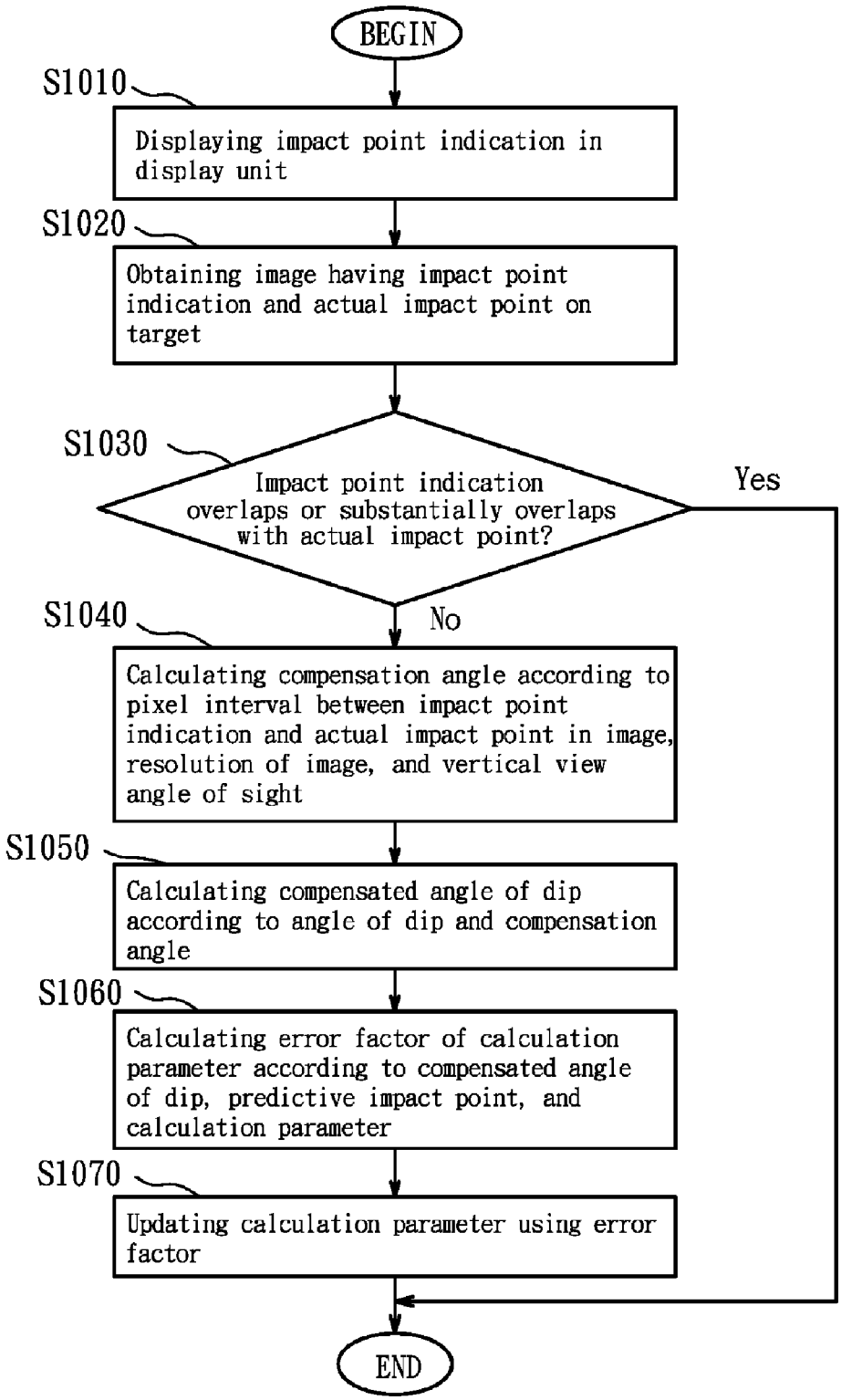
FIG. 10 is a flowchart of another embodiment of a method of operation for a sight of the invention.

FIG. 10 is a flowchart of another embodiment of a method of operation for a sight of the invention. It is noted that, the sight of the present invention can be set on a shooting device, such as a firearms comprising a rifle or a long gun, a bow, or a crossbow. In the embodiment, a correction operation is performed, wherein a predictive impact point can be obtained by using the measurements for angle of dip, and an actual impact point can be obtained after the actual shooting. The pixel interval can be calculated via an image process, and transformed into an angle difference. According to the error between the theory value and the actual value, the initial velocity of the projectile can be calculated. The initial velocity can be bring into the equation for calculating the predictive impact point, thus to obtain the error correction corresponding to the trajectory compensation.

In step S1010, an impact point indication is displayed in a display unit of the sight. In some embodiments, an angle of dip of the sight to a plane can be detected via a dip angle detector of the sight. It is understood that, in some embodiments, the sight can perform a zeroing calibration, and the dip angle detector can detect the angle of dip at this time, and record the angle of dip after the zeroing calibration. Thereafter, the dip angle detector detects the angle of dip of the sight to the plane based on the angle of dip after the zeroing calibration. A predictive impact point can be calculated according to the angle of dip and at least one calculation parameter, and the impact point indication can be displayed in the display unit according to the predictive impact point. It is understood that, in some embodiments, the at least one calculation factor can comprise the air resistance, the weight of the projectile, the velocity of the projectile, the wind velocity, and/or the wind direction. In some embodiments, the predictive impact point can be a distance between the target and the sight. The calculation corresponding to the predictive impact point can be performed according to the trajectory of the firearms equipped with the sight and the physics mechanics. It is noted that, the calculations for the trajectory and the predictive impact point are well-known, and omitted here. Additionally, the impact point indication can be displayed in the display unit according to the distance of the predictive impact point and the target distance used in the zeroing calibration. For example, when the distance of the predictive impact point is greater than the target distance used in the zeroing calibration, the impact point indication can be displayed below the predefined view center of the display unit. When the distance of the predictive impact point is less than the target distance used in the zeroing calibration, the impact point indication can be displayed above the predefined view center of the display unit. In step S1020, an image is obtained by an image capture unit, wherein the image has an impact point indication corresponding to the predictive impact point and an actual impact point on a target. It is noted that, in some embodiments, the impact point indication corresponding to the predictive impact point can be only displayed in the display unit, and not in the image. It is noted that, a user can aim the target according to a mark of a predefined view center of the display unit of the sight and the above impact point indication, and use the shooting device to shoot a projectile on the target, thus to generate the actual impact point. In step S1030, it is determined whether the predictive impact point overlaps with or substantially overlaps with the actual impact point. When the predictive impact point overlaps with or substantially overlaps with the actual impact point (Yes in step S1030), the procedure is completed. When the predictive impact point does not overlap with or substantially overlap with the actual impact point (No in step S1030), in step S1040, a compensation angle is calculated according to a pixel interval between the impact point indication and the actual impact point in the image, a resolution of the image, and a vertical view angle of the sight. For example, it is assumed that the vertical view angle of the sight is 2°, and the resolution of the display (image) is 960×540, each vertical pixel in the display (image) represents 2/540° (unit pixel degree). The compensation angle can be obtained by multiplying the unit pixel degree by the pixel interval between the impact point indication and the actual impact point. Then, in step S1050, a compensated angle of dip is calculated according to the angle of dip corresponding to the impact point indication in step S1010 and the compensation angle, and in step S1060, an error factor is calculated according to the compensated angle of dip, the predictive impact point, and the above calculation parameter, the trajectory of the firearms equipped with the sight, and the physics mechanics. It is noted that, in some embodiments, the error factor may be one of the above calculation parameter, such as the projectile velocity. After the error factor is obtained, in step S1070, the above calculation parameter is updated using the error factor.

Therefore, the sights and the methods of operation thereof can automatically perform the zeroing calibration and/or provide aiming prompts, and perform corrections for aiming prompts, thereby providing more convenient and efficient assists for shooting aiming.

Method of operation for sights or certain aspects or portions thereof, may take the form of a program code (i.e., executable instructions) embodied in tangible media, such as floppy diskettes, CD-ROMS, hard drives, or any other machine-readable storage medium, wherein, when the program code is loaded into and executed by a machine, such as a computer, the machine thereby becomes an apparatus for practicing the methods. When implemented on a general-purpose processor, the program code combines with the processor to provide a unique apparatus that operates analogously to the application of specific logic circuits.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A sight, comprising:

a display unit;

an image capture unit obtaining an image, wherein the image has at least three impact points on a target; and a processing unit calculating a center position according to the positions of the at least three impact points in the image, and setting a predefined view center of the display unit to the center position.

2. The sight of claim 1, wherein an image range obtained by the image capture unit is larger than a view range of the display unit, after the predefined view center is set to the center position of the at least three impact points, the display unit obtains an image portion corresponding to the view range from the image range according to the center position, thus to display the image portion in the display unit.

3. The sight of claim 1, wherein the at least three impact points are generated by shooting projectiles on the target by a firearms equipped with the sight according to the predefined view center, and the at least three impact points are within a predefined range.

4. The sight of claim 1, wherein the sight further comprises an optical module having no back-end upright optics group or an eyepiece, wherein the image capture unit obtained the image via the optical module.

5. A sight, comprising:

a display unit;

a dip angle detector detecting an angle of dip of the sight to a plane; and a processing unit calculating a predictive impact point according to the angle of dip and at least one calculation parameter, and displaying an impact point indication in the display unit accordingly to the predictive impact point, and when the angle of dip is changed, re-calculating the predictive impact point according to the new angle of dip and the at least one calculation parameter, and re-displaying the corresponding impact point indication in the display unit.

6. The sight of claim 5, wherein the at least one calculation factor comprises air resistance, a weight of a projectile, or a velocity of the projectile.

7. The sight of claim 5, wherein the predictive impact point is a distance between the sight and a target.

8. The sight of claim 5, wherein the processing unit further obtains a predictive distance between the sight and a target using a distance measurement method, and displays a specific prompt in the display unit according to the predictive distance.

9. The sight of claim 8, wherein the distance measurement method comprises a triangle distance measurement method, a laser distance measurement method, an IR distance measurement method, or an ultrasonic distance measurement method.

10. The sight of claim 8, wherein the specific prompt comprises a text display corresponding to the predictive distance, or a specific indication displayed at a specific position corresponding to the predictive distance in the display unit.

11. The sight of claim 10, wherein the processing unit further determines whether the impact point indication overlaps with the specific indication, when the impact point indication overlaps with the specific indication, generates a registration prompt.

12. The sight of claim 11, wherein the registration prompt comprises a voice, a text, a numeral, a symbol, or a change of color of the impact point indication or the specific indication.

13. The sight of claim 5, wherein the display unit comprises a head mounted display, a display panel, a view finder of the sight, or a micro-display having a magnification eyepiece.

14. The sight of claim 5, wherein the processing unit further performs a correction operation, wherein the correction operation comprises the steps of:

obtaining an image by an image capture unit, wherein the image has an actual impact point on a target;

calculating a compensation angle according to a pixel interval between an impact point indication and the actual impact point in the image, a resolution of the image, and a vertical view angle of the sight;

calculating a compensated angle of dip according to the angle of dip and the compensation angle;

calculating an error factor of the at least one calculation parameter according to the compensated angle of dip, the predictive impact point, and the at least one calculation parameter; and updating the at least one calculation parameter using the error factor.

15. The sight of claim 14, wherein the error factor comprises an initial velocity of a projectile.

16. A sight, comprising:

a display unit;

a dip angle detector detecting an angle of dip of the sight to a plane;

an image capture unit obtaining an image, wherein the image comprises at least an actual impact point on a target, and a predictive impact point is calculated according to the angle of dip and at least one calculation parameter, wherein the impact point indication is displayed in the display unit according to the predictive impact point; and a processing unit calculating a compensation angle according to a pixel interval between the impact point indication and the actual impact point in the image, a resolution of the image, and a vertical view angle of the sight, and calculating a compensated angle of dip according to the angle of dip and the compensation angle, calculating an error factor of the at least one calculation parameter according to the compensated angle of dip, the predictive impact point, and the at least one calculation parameter, and updating the at least one calculation parameter using the error factor.

17. The sight of claim 16, wherein the error factor comprises an initial velocity of a projectile.

18. The sight of claim 16, wherein the processing unit further obtains a predictive distance between the sight and a target using a distance measurement method, and displays a specific prompt in the display unit according to the predictive distance.

19. The sight of claim 18, wherein the specific prompt comprises a text display corresponding to the predictive distance, or a specific indication displayed at a specific position corresponding to the predictive distance in the display unit.

20. The sight of claim 19, wherein the processing unit further determines whether the impact point indication overlaps with the specific indication, when the impact point indication overlaps with the specific indication, generates a registration prompt.

* * * * *